US006155936A

United States Patent [19]

Dorr

[11] Patent Number: 6,155,936

[45] Date of Patent: Dec. 5, 2000

[54] BASEBALL PITCHER'S PRACTICE TARGET WITH BALL RETURN

[76] Inventor: Kenneth C. Dorr, 1630 University Ave., Apt. 50, Berkeley, Calif. 94703

[21] Appl. No.: 09/338,220

[22] Filed: Jun. 22, 1999

Related U.S. Application Data

[60] Provisional application No. 60/090,365, Jun. 23, 1998.

[51] Int. Cl.[7] ..... A63B 69/00

[52] U.S. Cl. ..... 473/456; 473/436; 473/433; 473/421; 273/376; 124/6

[58] Field of Search ..... 473/421–424, 473/454, 455, 435, 436, 462, 456; 273/406, 407, 374–376, 392, 402

[56] References Cited

U.S. PATENT DOCUMENTS 2,657,058 10/1953 Mulcahy ..... 473/436
5,133,548 7/1992 Bedord et al. ..... 473/436
5,573,239 11/1996 Ryker et al. ..... 473/436
5,776,018 7/1998 Simpson et al. ..... 473/433

*Primary Examiner*—Mark S. Graham
*Assistant Examiner*—Mitra Aryanpour

[57] ABSTRACT

A portable baseball pitcher's practice target device having a target panel with sub-target areas representing the upper, lower, inside, outside and center of an imaginary strike zone of a baseball batter. The user of the target device practices pitching baseballs toward the target with the objective of concentrating on the sub-target areas to improve the user's pitching accuracy and skill. The target device has a frame that supports the target and a back panel for collecting pitched balls that enter through the sub-target areas. A powered apparatus is included for returning baseballs that have passed through the sub-target areas and resilient surfaces for returning balls that do not enter the sub-target areas.

15 Claims, 5 Drawing Sheets

BASEBALL PITCHER'S PRACTICE TARGET WITH BALL RETURN

This application claims priority from a Provisional Patent Application 60/090,365 filed Jun. 23, 1998.

FIELD OF THE INVENTION

This invention relates to a device for use in self-practice of baseball pitching skills, and more particularly to a portable supported target device representative of the strike zone area of a baseball batter including sub-target areas within the strike zone and including means for return of baseballs striking or passing through the target from the device to the person performing self-practice.

BACKGROUND OF THE INVENTION

One element of the game of baseball is the pitting of the skill of a pitcher in throwing a baseball against the skill of a batter in hitting the pitched ball. Part of the skill of the pitcher is to direct the pitched ball with respect to a desired area of the strike zone for the batter. The strike zone may be defined as that area above a home plate and within the lateral edge boundaries of the home plate and generally below the arm-pit area and above the knee area of a batter. Those pitchers that are particularly skilled and successful in the art of pitching are capable of directing the pitched ball to specific areas within (or outside) of the strike zone. Skill at pitching to a desired area comes only with repeated practice at pitching the baseball to the desired area. Pitchers and coaches of pitchers suggest that the pitching of about 100 practice pitches in each practice session is helpfull, if not essential, to becoming an accomplished pitcher. Self-practice is a means for accomplishing the desired skill and, with the assistance of a suitable practice device, the practice can be accomplished without the involvement of additional persons to catch, return and evaluate the accuracy of each practice pitch.

SUMMARY OF THE INVENTION

The present invention is a portable baseball pitcher's practice target device with return means for assisting in the repeated pitching of a baseball to a target area. The device includes a target panel resiliently supported on a rigid frame. The target includes sub-target areas representing positions within and outside of an imaginary strike zone above a baseball home plate. The sub-target areas are cut-out portions of the main target that represent areas of the imaginary strike zone that are high inside and outside, low inside and outside and center within the strike zone. Pitched baseballs that pass through the cut-out areas are gathered by a back panel of the device and dropped to a collection area for return to the pitcher. Baseballs that miss the cut-out areas are returned toward the pitcher by the resilient mounting of the target panel to the front frame. A powered return means is included for return of the baseballs that pass through the cut-out areas with a sensing means for energizing the return means as a baseball drops to the collecting area.

The practice target device is constructed of sturdy materials that will withstand the repeated contact with pitched balls while being sufficiently weighted to be unmoved by the pitched ball. The device includes support wheels appropriately spaced from the target area to permit ease of transporting the target device to practice areas.

An object of the present invention is an easily portable baseball pitcher's practice device that will provide a target area for practice in pitching to the imaginary baseball strike zone and with convenient return means for pitched balls that strike or pass through sub-target areas in the practice device.

Further objects and features of the present invention will be readily apparent to those skilled in the art from the appended drawings and specification illustrating a preferred embodiment wherein:

DETAILED DESCRIPTION OF THE PREFERRED EMBODIMENTS

Figure 1:
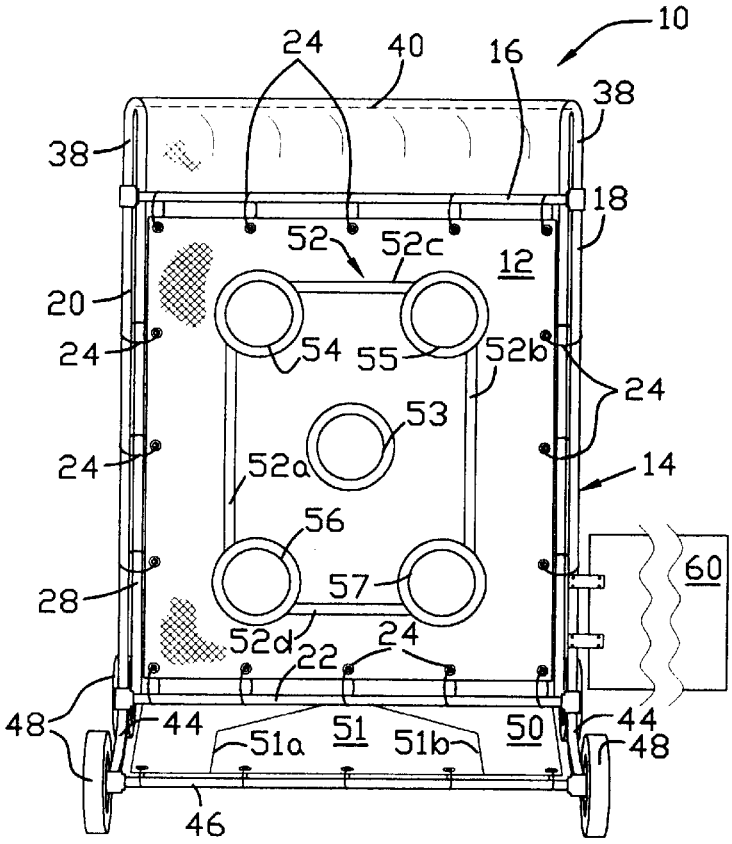
FIG. 1 is a front perspective view of the target device.

The portable baseball pitcher's practice target device of the present invention is illustrated in FIG. 1 wherein the device 10 comprises a front face target panel 12 resiliently supported on a front frame 14. The target is preferably formed from a woven fabric that can withstand stresses in many directions; one such fabric is the woven fabric Textilene used in outdoor furniture. The frame 14 includes a top portion 16, side portions 18 and 20, and bottom portion 22. The frame portions are preferably made of tubular members that are both strong enough to support the target and to withstand the absorption of energy from pitched balls as well as to be adapted to withstand any form of weather conditions. The target panel 12 is resiliently attached to the front frame by a plurality of elastic tie members 24 cooperating with holes or grommets in the target panel and looping around the frame portions 14–22.

Figure 3:
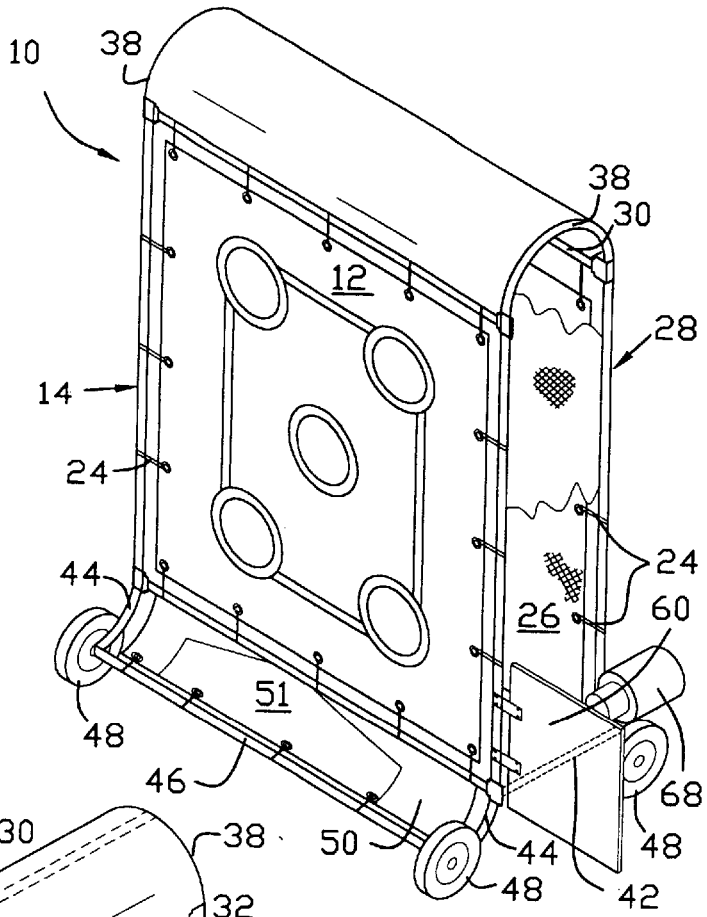
FIG. 3 is a perspective view of the right front side of the target device.
Figure 4:
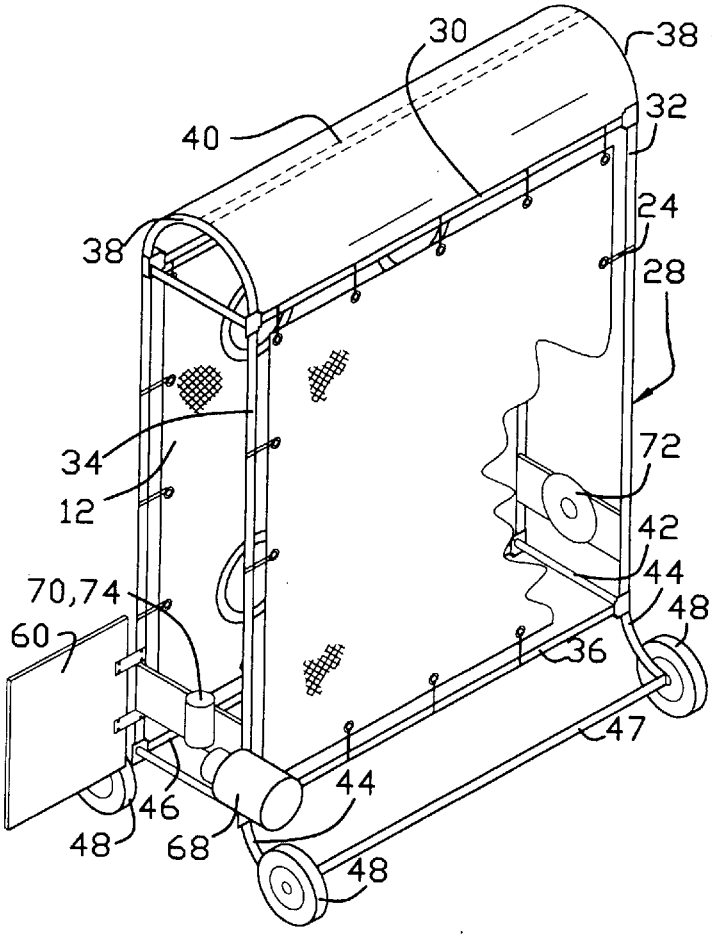
FIG. 4 is a perspective view of the right back side of the target device.
Figure 5:
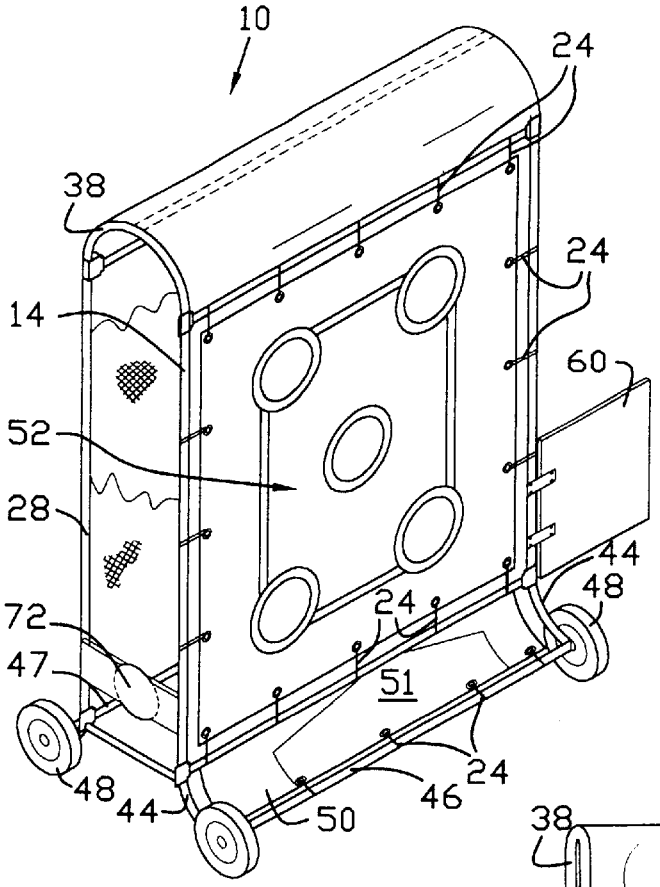
FIG. 5 is a perspective view of the left front side of the target device.
Figure 6:
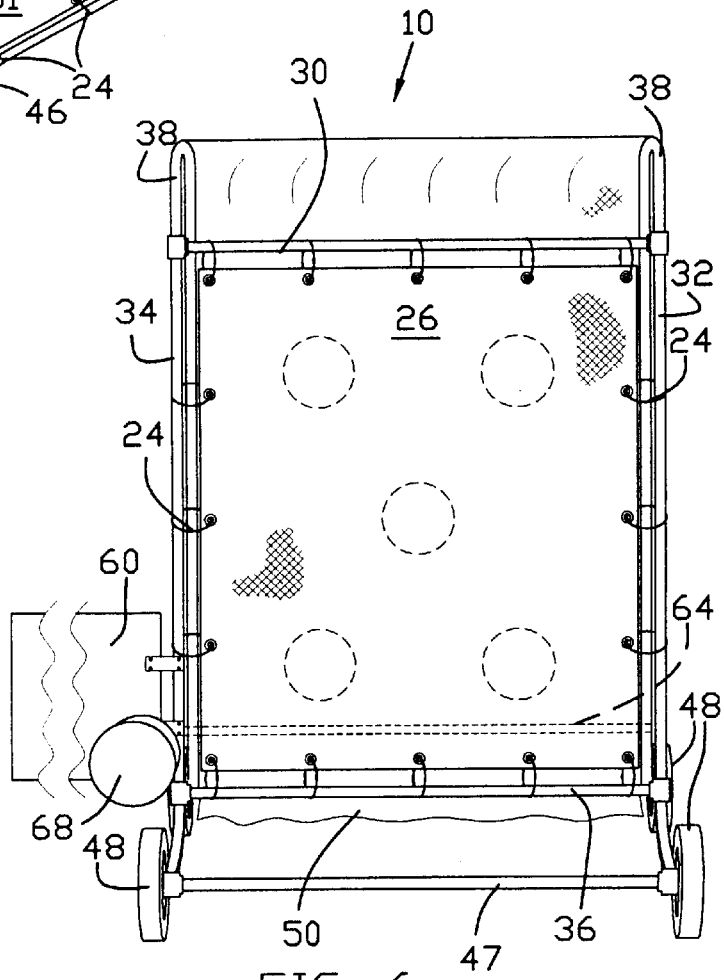
FIG. 6 is a perspective view of the back of the target device.
Figure 7:
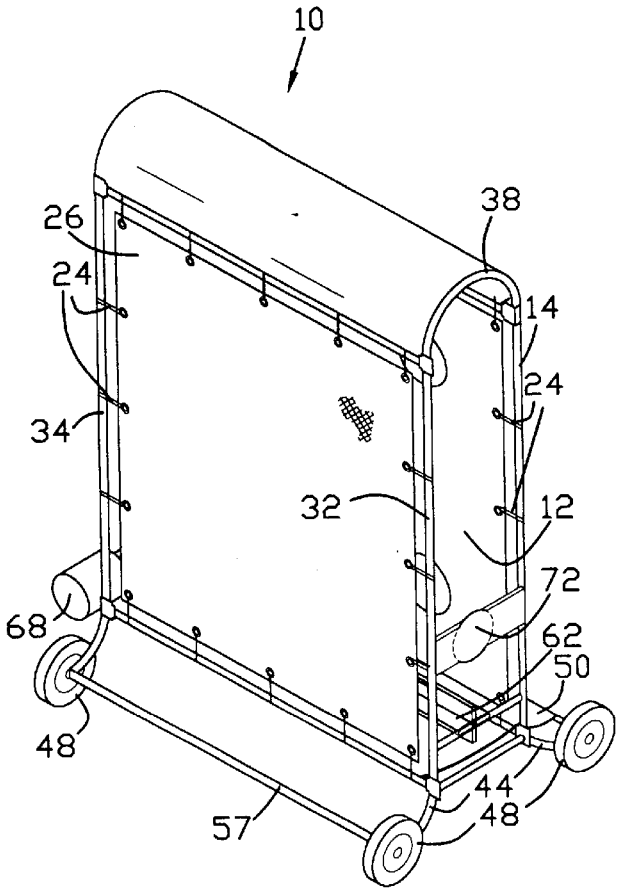
FIG. 7 is a perspective view of the back left side of the target device.

The target device further includes a back panel 26, seen more clearly in FIGS. 3 and 4, supported on a rear frame 28. The back panel, like the front panel, is also preferably formed of a woven fabric having the necessary strength to withstand forces of a pitched ball and a variety of weather conditions. The back frame 28 includes a top portion 30, two side portions 32 and 34, and a bottom portion 36 all preferably formed of materials similar to those identified for the front frame. The back panel is resiliently attached to the back frame by a plurality of elastic tie members 24 as described with respect to the front panel. Not all of the tie members are shown and it should be understood that enough tie members will be used to accomplish the desired mounting and resilient support as will be described hereinafter.

The tops of the front and back frames are connected by a pair of formed members 38 attached to the junction of the top and side portions of those frames and a lateral spacer bar

40 extends along the midportion of the formed members to provide a top for the target device and to strengthen the structure.

The bottoms of the front and back frames are connected by a pair of depth spacer bars 42 that establish the spacing depth between the front target panel 12 and the back panel 26. Formed support extension members 44 are attached to the junction of the side and bottom portions of the front and back frames 14 and 28 and the extension members 44 attach at their ends to a front wheel support axle 46 and a rear wheel support axle 47, each axle having a pair of wheels 48 rotatably supported at their ends.

A protective panel 60 is provided at the lower side of the structure in front of the return drive motor and its controls.

The frames, spacers and support members form a portable target device that can be easily transported from place to place by rolling along the wheel support. The spacing of the front and back frames establishes a spaced interior into which pitched balls passing through the target panel will be collected. The top and sides of the framed device are enclosed by fabric materials, preferably of the same material as the target and back panel, and joined to the frame elements by resilient ties or suitable fasteners.

The target panel and back panel may be attached to the frames of the target device by forming the panels with interior seams along their edges through which the frame portions may be passed. Other forms of resilient mountings may be used to both absorb the energy of the pitched ball and return the ball to the pitcher.

The bottom of the target device is equipped with a return panel 50 that closes the bottom of the target device by being attached to the front wheel support axle 46 by suitable tie members and to the rear frame bottom portion 36. The junction of the interior of the back panel 26 and the return panel 50 forms a collection area within the interior of the target device.

The return panel 50 is marked with the representation of a home plate 51 that becomes the source of practice target dimensions for the target device. The front face target panel 12 is marked with an interior target area 52 and formed with a plurality of interior marked sub-target means 53, 54, 55, 56 and 57. The interior target area 52 has its side dimensions 52*a* and 52*b* as vertical projections of the sides 51*a* and 51*b* of the marked home plate 51. The interior target area 52 has its upper marking 52*c* and lower marking 52*d* as the imaginary upper and lower strike zone for a baseball batter. The interior sub-targets are formed as cut-out portions through the front panel 14 and establish passageways through which a pitched ball may pass to the back panel 26 and the interior of the target device. The cut-out portions may be of any reasonable size to allow some leadway for balls hitting the sub-targets. A representative size for the front panel is 27 inches in width and 33 inches in height, the width of the interior strike zone from 52*a* to 52*b* is 17 inches, the size of the cut-outs is 5 inches in diameter, and the height between 52*c* and 52*d* is 24 inches.

The target device of the present invention is equipped with powered means for returning baseballs that pass through the sub-target areas to the pitcher throwing the balls. For that purpose, a paddle wheel 62 is positioned within the interior of the target device in the collection area formed by the return panel 50 and the back panel 26. The paddle wheel 62 having a plurality of paddle surfaces 63 spaced from each other to accommodate a baseball is supported on a shaft 64 extending through the collection area and rotatably supported in bushings 66*a* and 66*b* attached by brackets 67 to the side portions of the front and back frames 14 and 28, respectively. Bushing 66*b* includes a gear reduction drive to the paddle wheel shaft 64 with a mechanical connection to a powered drive motor 68. The function of the paddle wheel 62 and its drive from motor 68 is to engage a baseball that passes to the collection area and to drive the ball through the collection area, along the return panel and back to the pitcher that threw the ball.

Figure 9:
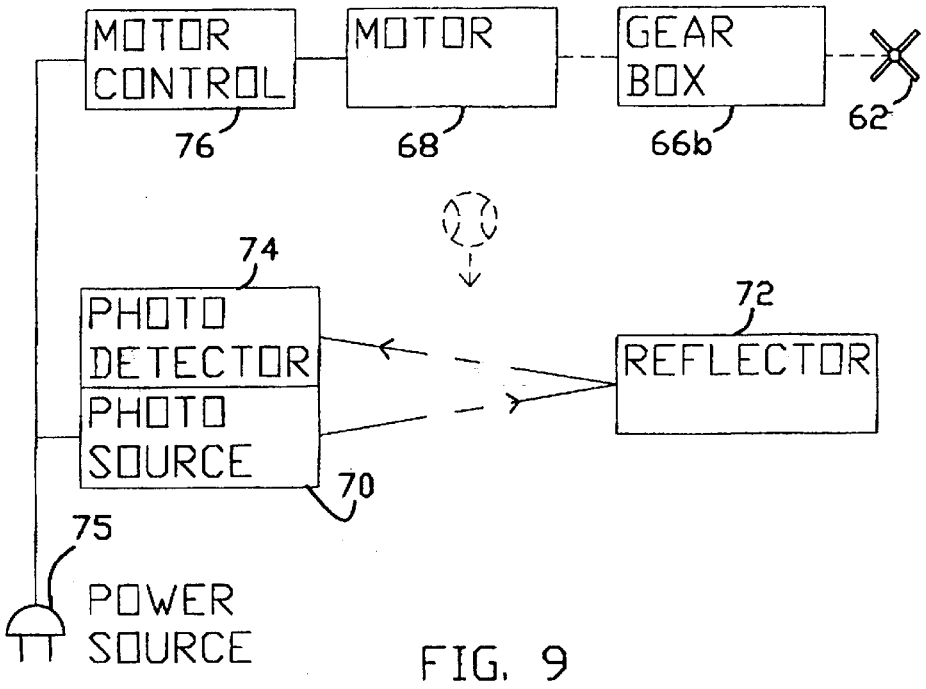
FIG. 9 is a block diagram of the motor control system for the ball return mechanism.
Figure 8:
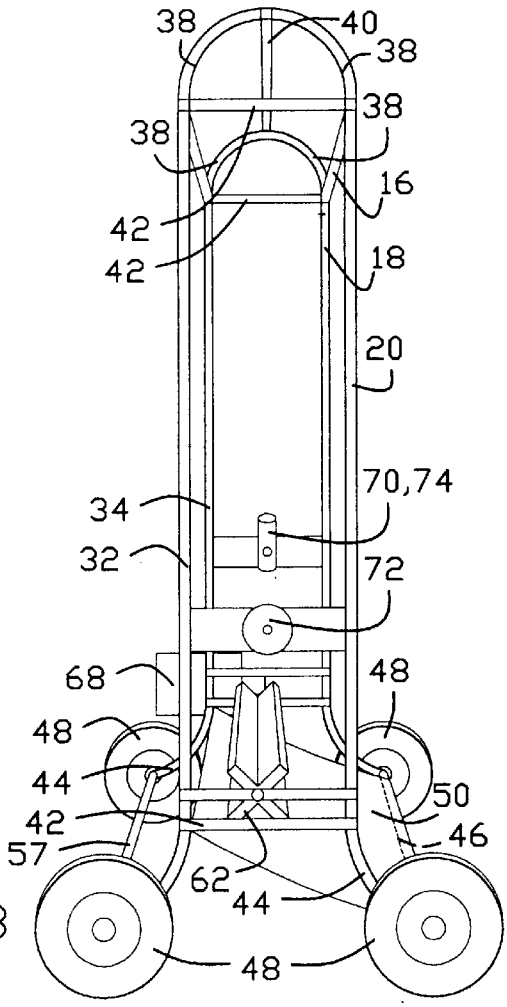
FIG. 8 is a perspective view of the left side of the device with the covering material removed and showing the ball return mechanism.
Figure 10:
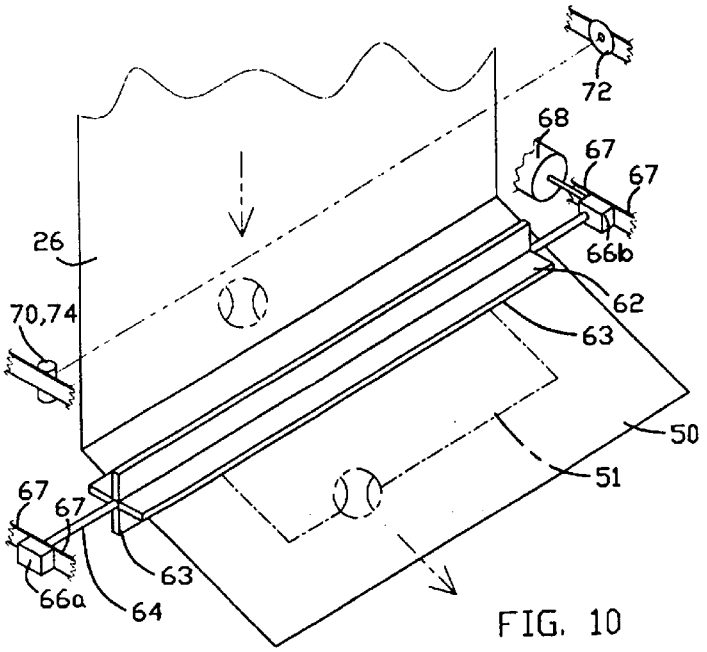
FIG. 10 is a perspective view of one form of a ball return mechanism.

FIGS. 9 and 10 illustrate a representative control system for the powered return of balls from the target device. The actuation of the drive motor 68 is dependent upon the presence of a ball in or entering the collection area. For that purpose the target device is equipped with a photo sensitive motor control system. A light source 70 is mounted on the interior of the frame structure of the target device below the area behind the lower sub-target areas 56 and 57 and above the collection area where the return panel 50 and back panel 28 are joined. The light source produces a beam of light through the collection area in the path of a ball. A reflector 72 for the light beam is mounted at the opposite side of the target device in a position to reflect the light beam back toward the light source 70 to a photo detector 74. The light beam from the source to the detector is continuous except when a ball falls into the collection area and interrupts the light beam. The photo detector 74 actuates a motor control 76 when a ball is detected in the collection area. If a reflected beam of light is detected in the detector 74, no signal is sent to the motor control, if the beam is interrupted, the photo detector actuates the motor control and motor 68 drives the paddle wheel through the gear box in bushing 66*b*. The motor continues its drive for a set period of time after each interruption to assure that a ball in the collection area is sent out through the return path.

The photo detection devices may be a source and a detector at the opposite side of the structure rather than a reflector system returning the light beam to the source area.

Energy for energizing the motor and its controls may be provided by a power connection device at 75 which may be connected to an AC or DC source. The device may also be powered by a self-contained battery source for both the motor controls and motor drive.

Figure 2:
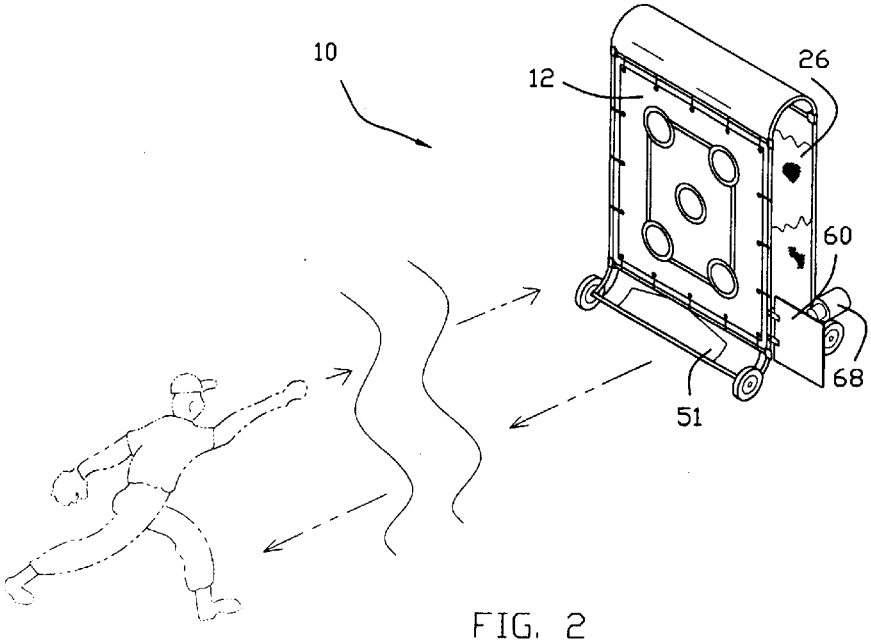
FIG. 2 is perspective view of the invention in use.

The operation of the present invention should be readily apparent from the foregoing description of the elements that comprise the structure. The objective of this self-practice target device is to give the user a chance to practice accuracy in pitching to selected areas of an imaginary baseball strike zone. Continued use of the device should improve the user accuracy and capabilities as a baseball pitcher. It should be understood that pitching accuracy applies not only to pitching to areas within the so called strike zone but also to areas near the batter but outside of the strike zone. Continued practice at pitching accuracy will serve the pitcher well in improving pitching skills. The device may be used by pitchers of all ages with modification of the size of the target area and the distance between the user and the targets. As illustrated in FIG. 2, a pitcher shown in phantom, is spaced a desired distance from the target in a pitching position and pitches the ball toward the target and, if a sub-target area has been reached, the ball is returned from the return panel. If the ball does not enter through a sub-target area it will be rebounded by the resilient mounting of the target panel and the user may derive some practice in fielding fly or ground balls. Because the baseball pitcher's practice target device is useable by a sole person, there is no need for another person to participate in the practice session. A coach may even stand near the user to get closeup observation of the pitching technique and to give direct instruction for continued practice.

The structure and its elements are so positioned that the center of gravity of the structure is just above the bottom of the target panel because of the weight of the motor and its controls mounted near the bottom of the structure. The position of the wheels on the extensions from the frame lower portions gives the structure a sturdy mounting on a ground surface. The frame members are preferably made of tubular material either metallic or plastic and the structural members may be solid metallic or plastic to provide strength and reduced weight. The use of woven fabric panels reduces the wind resistance of the target device and the resilient mounting of the target panel and the back panel to their respective frames provides for absoprtion of the energy of the thrown ball. The protective panel in front of the motor and the motor controls provides protection against damage to those elements by misdirected pitches.

While certain preferred embodiments of the invention have been specifically disclosed, it should be understood that the invention is not limited thereto as many variations will be readily apparent to those skilled in the art and the invention is to be given its broadest possible interpertation within the terms of the following claims.

I claim:

1. A portable baseball pitcher's practice target device for baseballs including separate sub-target means representing positions within an imaginary baseball strike zone comprising:

a flexible front target panel, a plurality of cut-out portions within said front target panel, said cut-out portions being relatively spaced with respect to each other to designate said sub-targets within said front target panel, a front target frame having top, bottom and side portions for supporting said front target panel with open space below said target panel, a flexible back panel behind said front target panel, a second frame having top, bottom and side portions for supporting said back panel in spaced relationship with respect to and behind said front target panel, said front target panel frame and said second frame being attached in spaced relationship at said top and bottom portions, side and top panels enclosing the space between said front target panel and said back panel, a return panel in cooperating alignment with said back panel and including a lower portion extending below said front target panel into said open space below said front target panel, a collecting area extending across said target device behind said front target panel for individual baseballs passing through said cut-out portions in said front target panel and into contact with said back panel, a rotatable shaft extending across said target device behind and below said front target panel in front of said back panel and in cooperating alignment with the lower portion of said return panel, paddle means attached to said rotatable shaft and extending across said target device for propelling individual collected baseballs, and drive means for rotating said rotatable shaft and paddle means to return collected baseballs to and beyond the front of said front target panel through said open space below said front target panel.

2. The device of claim 1 wherein said target panel is a fabric panel.

3. The device of claim 1 wherein said plurality of cut-out portions is five separate cut-out portions.

4. The device of claim 3 wherein said plurality of cut-out portions includes a center cut-out, upper left and right cut-out portions relatively spaced above said center cut-out portion and laterally spaced therefrom, and lower left and right cut-out portions relatively spaced below said center cut-out portion and laterally spaced therefrom.

5. The device of claim 4 wherein said relative spacing of said plurality of cut-out portions is representative of the width of a baseball homeplate in lateral width between left and right cut-outs, relative spacing of upper cut-out portions above said central cut-out portion is representative of the upper limit of a strike zone, and relative spacing of lower cut-out portions below said central cut-out portion is representative of the lower limit of a strike zone.

6. The device of claim 1 including flexible elastic fasteners attaching said front target panel fabric to said frame at said top, bottom and side portions.

7. The device of claim 1 including flexible elastic fasteners attaching said back panel to said second frame at said top, bottom and side portions.

8. The device of claim 1 including a plurality of rotatable wheels supporting said attached front target panel frame and said back panel frame for transporting said target device.

9. The device of claim 8 wherein said wheels are attached to extensions of said front target frame and said second frame to stabilize said device.

10. The device of claim 1 including means for sensing the collection of an individual baseball in said collecting area, said sensing means actuating said drive means to propel said individual collected baseball out of said open space below said front target frame.

11. The device of claim 10 wherein said sensing means is a photoelectric means for sensing the collection of an individual baseball in said collecting area.

12. The device of claim 1 including a protection panel attached to said target frame in alignment with said means for propelling to protect said means for propelling from baseballs.

13. The device of claim 1 wherein said paddle means includes a plurality of paddle surfaces spaced from each other to accommodate an individual baseball and to propel said baseball through said collection area and along said return panel and out of said open space below said front target frame.

14. The device of claim 10 wherein said drive means and said means for sensing are adapted to be powered by either AC/DC service power supply or a self-contained power supply.

15. The device of claim 1 wherein said flexible front target panel and said flexible back panel include perimeter seams adapted to cooperate with said target frame and said second frame for mounting said panels to said frames.

* * * * *